US009505037B2

(12) United States Patent
Kane et al.

(10) Patent No.: US 9,505,037 B2
(45) Date of Patent: Nov. 29, 2016

(54) PORTABLE COIL CLEANING AND VACUUM SYSTEM

(71) Applicant: Crossford International, LLC, Stamford, CT (US)

(72) Inventors: Timothy J. Kane, Greenwich, CT (US); Frank Intrieri, Jr., Cos Cob, CT (US); Pete Gentile, White Plains, NY (US); David L. Walsh, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 0 days.

(21) Appl. No.: 14/964,880

(22) Filed: Dec. 10, 2015

(65) Prior Publication Data

US 2016/0088986 A1 Mar. 31, 2016

Related U.S. Application Data

(63) Continuation-in-part of application No. 14/595,730, filed on Jan. 13, 2015.

(60) Provisional application No. 62/128,810, filed on Mar. 5, 2015, provisional application No. 61/964,668, filed on Jan. 13, 2014.

(51) Int. Cl.

| | |
|---|---|
| ***B08B 3/02*** | (2006.01) |
| ***B08B 5/04*** | (2006.01) |
| ***F25B 47/00*** | (2006.01) |
| ***F28G 9/00*** | (2006.01) |

(52) U.S. Cl.

CPC . *B08B 5/04* (2013.01); *B08B 3/02* (2013.01); *B08B 3/026* (2013.01); *F25B 47/00* (2013.01); *F28G 9/00* (2013.01)

(58) Field of Classification Search

CPC ..... B08B 3/026

See application file for complete search history.

(56) References Cited

U.S. PATENT DOCUMENTS

| | | | |
|---|---|---|---|
| 5,421,900 | A | 6/1995 | Clontz |
| 5,935,341 | A | 8/1999 | Kosofsky et al. |
| 6,062,486 | A | 5/2000 | Hill |
| 7,028,925 | B2 | 4/2006 | Guest et al. |
| 7,624,470 | B2 | 12/2009 | Heyman |
| 7,841,351 | B1 | 11/2010 | Kane et al. |
| 8,468,648 | B1 | 6/2013 | Smith et al. |
| 2003/0056812 | A1 | 3/2003 | Baker et al. |
| 2006/0260654 | A1 | 11/2006 | Denney |
| 2009/0283113 | A1 | 11/2009 | Munch |
| 2014/0352920 | A1 | 12/2014 | Walker |
| 2015/0211819 | A1 | 7/2015 | Lindstrom et al. |

FOREIGN PATENT DOCUMENTS

| | | |
|---|---|---|
| EP | 2236222 | 1/2013 |
| GB | 2462109 | 1/2010 |

OTHER PUBLICATIONS

Surface Condenser Cleaning Equipment (www.goodway.com/products/tube-cleaning/surface-condenser-tube-cleaners/surface-condenser-tube-cleaning-system#custom-quicktabs-tab-product_t . . .) download date: Sep. 3, 2015; 1 pp.

Written Opinion for PCT/US15/64922 dated May 12, 2016; 4 pps.

International Search Report for PCT/US15/64922 dated May 12, 2016; 2 pps.

*Primary Examiner* — Jason Ko

(74) *Attorney, Agent, or Firm* — Carson C. K. Fincham; Fincham Downs, LLC

(57) ABSTRACT

Systems, methods, apparatus, and articles of manufacture for portable coil cleaning and vacuum systems are provided.

5 Claims, 12 Drawing Sheets

PORTABLE COIL CLEANING AND VACUUM SYSTEM

CROSS-REFERENCE TO RELATED APPLICATIONS

The present applications (i) claims benefit and priority to, and is a non-provisional of, U.S. Provisional Patent Application No. 62/128,810 filed on Mar. 5, 2015 and titled "PORTABLE TUBE CLEANING SYSTEM" and (ii) claims benefit and priority to, and is a Continuation-in-Part (CiP) of, U.S. patent application Ser. No. 14/595,730 filed on Jan. 13, 2015 and titled "STAND-ALONE CHEMICAL DISPENSER", which itself claims benefit and priority to U.S. Provisional Patent Application No. 61/964,668 filed on Mar. 5, 2015 and titled "STAND-ALONE CHEMICAL DISPENSER". Each of these applications is hereby incorporated by reference in the entirety herein.

BACKGROUND

Heating, Ventilating, and Air-Conditioning (HVAC) systems, as well as other heating and cooling applications (e.g., refrigeration), often utilize coils, fins, and other heat-sink devices as part of a system to transfer heat from one environment to another. Many systems include both an evaporative coil (typically located inside a conditioned space) and a condensing coil (typically located in an external environment). Heat transfer and overall coil effectiveness is greatly dependent upon airflow across and through the coils/fins. As dirt and debris (e.g., dust, mold, etc.) accumulate on and within the coils, fins, etc., airflow becomes blocked and the efficiency of the system may be greatly reduced. While various methods for cleaning coils are available, typical professional cleaning often involves utilization of a wheeled cleaning unit that houses water and/or chemical supplies and has an extendable hose or wand that may be used to direct cleaning sprays at or through the coil to be cleaned. In some cases, it may be desirable to utilize a wet-dry vacuum device to remove loosened deposits, debris, and/or residual cleaning fluids from the coils. Portable cleaning units are available that provide for mounting and/or transportation of a cooperative vacuum device for such applications.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Embodiments presented herein are descriptive of systems, methods, apparatus, and articles of manufacture for portable coil cleaning and vacuum systems (and components thereof). The inventors have realized, for example, that previously available coil cleaning and vacuum systems could benefit from both a higher degree of integration and compatibility as well as specialized features that permit for the effective utilization of chemical tablets. In some embodiments, for example, hydraulic components of a coil cleaning system may be housed within one or more cavities or voids about which one or more of a water storage tank and a vacuum canister or tank are formed. According to some embodiments, tank/canister components may be formed as multi-purpose manufacturing parts that are of the same shape and size for ease of manufacturing but also are configured to function as either a water/fluid storage tank or a vacuum canister/tank, as desired. In some embodiments, specialized chemical tablet containers may be included in the system. The chemical tablet containers may comprise, for example, specialized chemical tablet cups or inserts that provide for desired chemical tablet dissolution within the chemical tablet containers.

II. Portable Coil Cleaning and Vacuum Systems

Figure 1A:
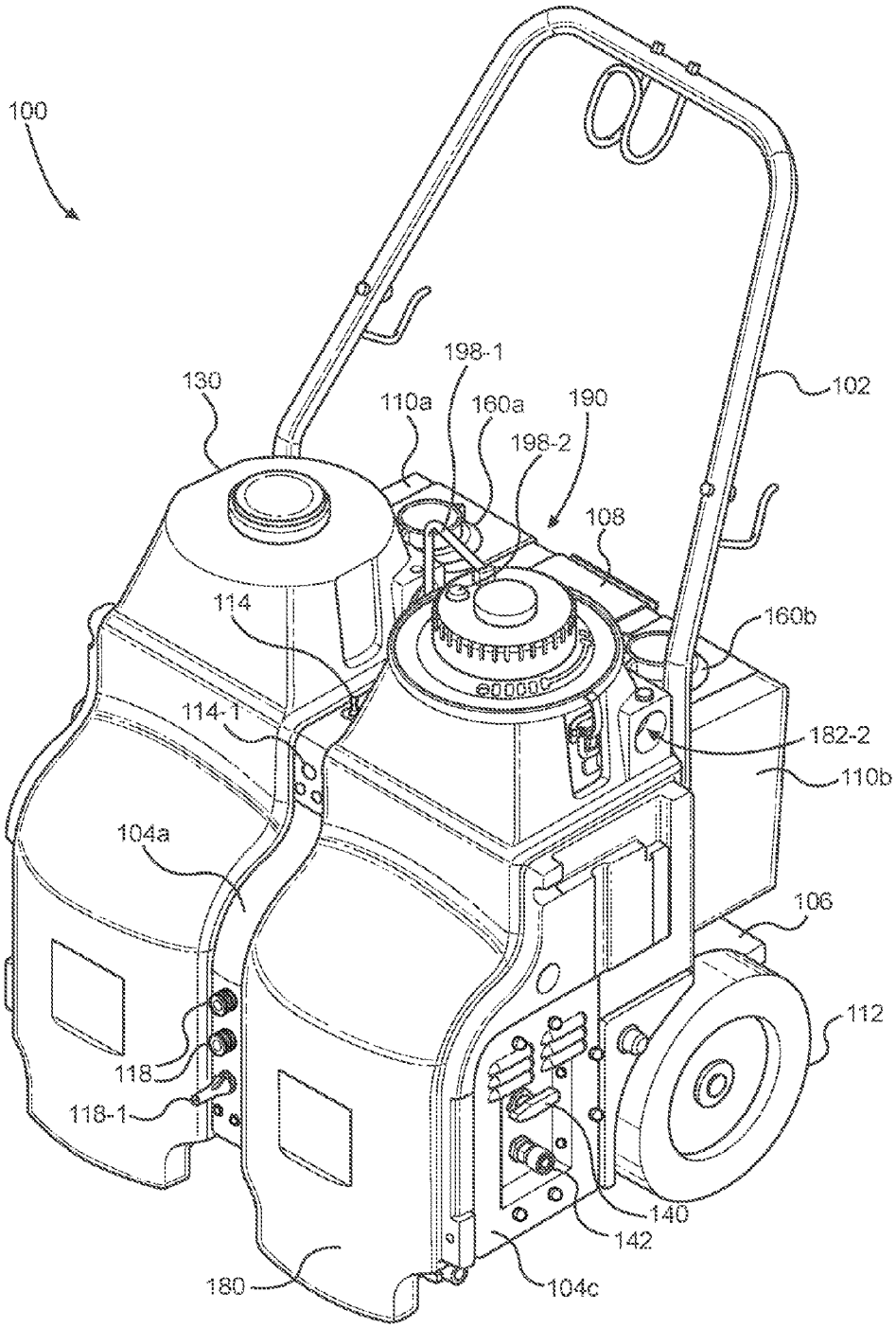
FIG. 1A is an upper, front-left perspective view of a portable coil cleaning and vacuum system according to some embodiments.
Figure 1B:
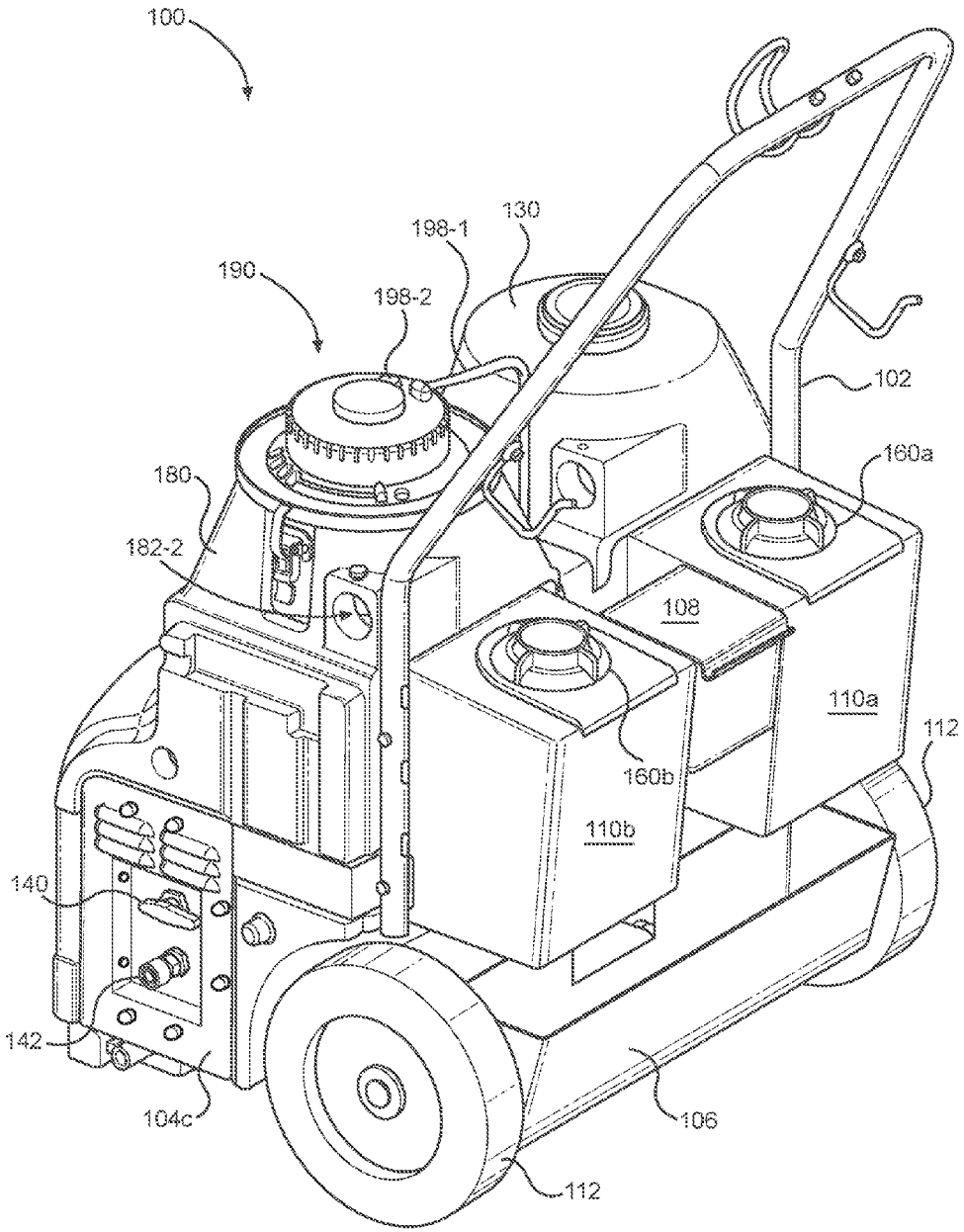
FIG. 1B is an upper, left-rear perspective view of the portable coil cleaning and vacuum system of FIG. 1A.
Figure 1C:
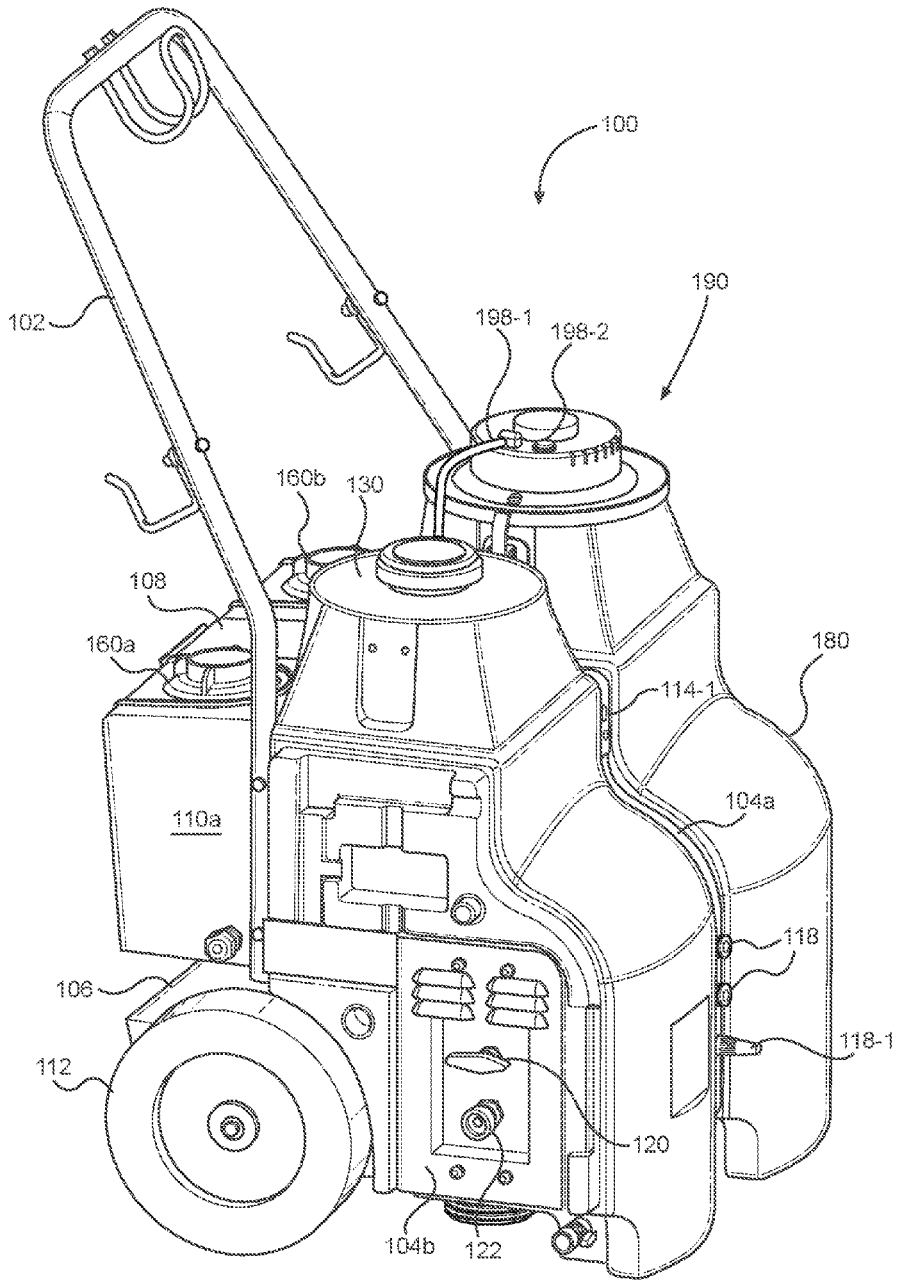
FIG. 1C is an upper, right-front perspective view of the portable coil cleaning and vacuum system of FIG. 1A and FIG. 1B.

Turning initially to FIG. 1A, FIG. 1B, and FIG. 1C, an upper, front-left perspective view, an upper, left-rear perspective view, and an upper, right-front perspective view, respectively, of a portable coil cleaning and vacuum system 100 according to some embodiments are shown. The portable coil cleaning and vacuum system 100 may comprise, for example, a frame 102, a plurality of housing portions 104*a-c* (e.g., a first or electrical housing portion 104*a*, a second or fluid inlet housing portion 104*b*, and/or a third or fluid outlet housing portion 104*c*), a drip or storage tray 106, a chemical tablet storage container 108, chemical tablet container housings 110*a-b*, and/or one or more wheels 112. In some embodiments, the portable coil cleaning and vacuum system 100 may comprise a power switch 114 and/or a power indicator light 114-1. In some embodiments, the power switch 114 may be utilized to operatively electrically switch the portable coil cleaning and vacuum system 100 (and/or one or more components thereof) between an "off" mode (e.g., a first position; in which components of the portable coil cleaning and vacuum system 100 are electrically isolated or disengaged) and an "on" mode (e.g., a second position; in which components of the portable coil cleaning and vacuum system 100 are electrically activated or engaged). In some embodiments, the power indicator light 114-1 may be illuminated in the case that the power switch 114 is engaged in the "on" mode or second position. According to some embodiments, the portable coil cleaning and vacuum system 100 and/or the first or electrical housing portion 104*a* thereof may comprise and/or define one or more accessory storage locations 118 such as may be utilized to store, accept, and/or couple to one or more nozzles 118-1 and/or other accessories (not shown).

In some embodiments, the portable coil cleaning and vacuum system 100 may comprise a first or fluid supply valve 120 hydraulically coupled to receive fluid (e.g., water) from one or more of a fluid inlet 122 and a fluid reservoir or tank 130. The fluid inlet 122 may comprise a hose adapter and/or coupling, for example, that enables coupling of the fluid inlet 122 to a garden hose or other external water supply (not shown), such as in the case that such an external supply or connection is available. In such a case, the fluid supply valve 120 may be selectively switched or engaged at a first position or orientation to cause the fluid supply valve 120 to accept or receive fluid from the fluid inlet 120. In the case that an external fluid supply is not available (or is not convenient), the fluid supply valve 120 may be selectively switched or engaged at a second position or orientation (e.g., as depicted in FIG. 1C) to cause the fluid supply valve 120 to accept or receive fluid from the fluid tank 130.

According to some embodiments, the fluid supply valve 120 may direct received fluid to a second or flow diverter valve 140. The flow diverter valve 140 may, for example, selectively direct or redirect fluid received from the fluid supply valve 120 to various pathways and/or components of the portable coil cleaning and vacuum system 100, and in some embodiments, ultimately to a fluid outlet 142. The fluid outlet 142 may, for example, provide pressurized fluid flow from the portable coil cleaning and vacuum system 100 to a connected hose, tube, applicator wand, and/or other system (none of which are shown) for utilization in various cleaning applications, such as commercial or industrial coil cleaning. The fluid supply valve 120 may be engaged at a first or rinse position, in some embodiments, such that the fluid supply valve 120 selectively directs received fluid directly to the fluid outlet 142 and/or to the fluid outlet 142 via a fluid pump (not shown in FIG. 1A, FIG. 1B, or FIG. 1C). According to some embodiments, the fluid supply valve 120 may be engaged at a second or first chemical tablet position such that the fluid supply valve 120 selectively directs received fluid through a first chemical tablet container 160*a* which provides a cleaning solution flow to the fluid outlet 142. According to some embodiments, the fluid supply valve 120 may be engaged at a third or second chemical tablet position such that the fluid supply valve 120 selectively directs received fluid through a second chemical tablet container 160*b* which provides a cleaning solution flow to the fluid outlet 142. According to some embodiments, the fluid supply valve 120 may comprise a mixing valve that permits portions or ratios of received fluid flow to be directed to various locations and/or components such as a first portion being directed to the first chemical tablet container 160*a*, a second portion being directed to the second chemical tablet container 160*b*, and/or a third portion being directed directly (and/or via a fluid pump) to the fluid outlet 142.

In some embodiments, the portable coil cleaning and vacuum system 100 may comprise a vacuum canister or tank 180 comprising a vacuum inlet 182-2 for accepting vacuumed debris/fluids, e.g., via a vacuum hose (not shown). The vacuum tank 180 may, for example, be coupled to the frame 102 and/or the fluid tank 130 (e.g., directly or via the electrical housing portion 104*a*). According to some embodiments, the vacuum tank 180 may house, accept, and/or be coupled to a vacuum unit 190 for providing suction to the vacuum inlet 182-2. The vacuum unit 190 may, for example, be disposed partially in the vacuum tank 180 such by being inserted into a top portion thereof as depicted. In some embodiments, the vacuum unit 190 may be electrically connected and/or powered via an electrical supply lead 198-1 (e.g., via the electrical housing portion 104*a* and/or the power switch 114) and/or may comprise a vacuum power button 198-2 operable to electrically engage a vacuum motor (not shown in FIG. 1A, FIG. 1B, or FIG. 1C) to provide suction to the vacuum inlet 182-2.

According to some embodiments, any or all of the components 102, 104*a-c*, 106, 108, 110*a-b*, 112, 114, 114-1, 118, 118-1, 120, 122, 130, 140, 142, 160*a-b*, 180, 182-2, 190, 198-1, 198-2 of the portable coil cleaning and vacuum system 100 may be similar in configuration and/or functionality to any similarly named and/or numbered components described herein. Fewer or more components 102, 104*a-c*, 106, 108, 110*a-b*, 112, 114, 114-1, 118, 118-1, 120, 122, 130, 140, 142, 160*a-b*, 180, 182-2, 190, 198-1, 198-2 (and/or portions thereof) and/or various configurations of the components 102, 104*a-c*, 106, 108, 110*a-b*, 112, 114, 114-1, 118, 118-1, 120, 122, 130, 140, 142, 160*a-b*, 180, 182-2, 190, 198-1, 198-2 may be included in the portable coil cleaning and vacuum system 100 without deviating from the scope of embodiments described herein. In some embodiments, one or more of the various components 102, 104*a-c*, 106, 108, 110*a-b*, 112, 114, 114-1, 118, 118-1, 120, 122, 130, 140, 142, 160*a-b*, 180, 182-2, 190, 198-1, 198-2 may not be needed and/or desired in the portable coil cleaning and vacuum system 100.

Figure 2A:
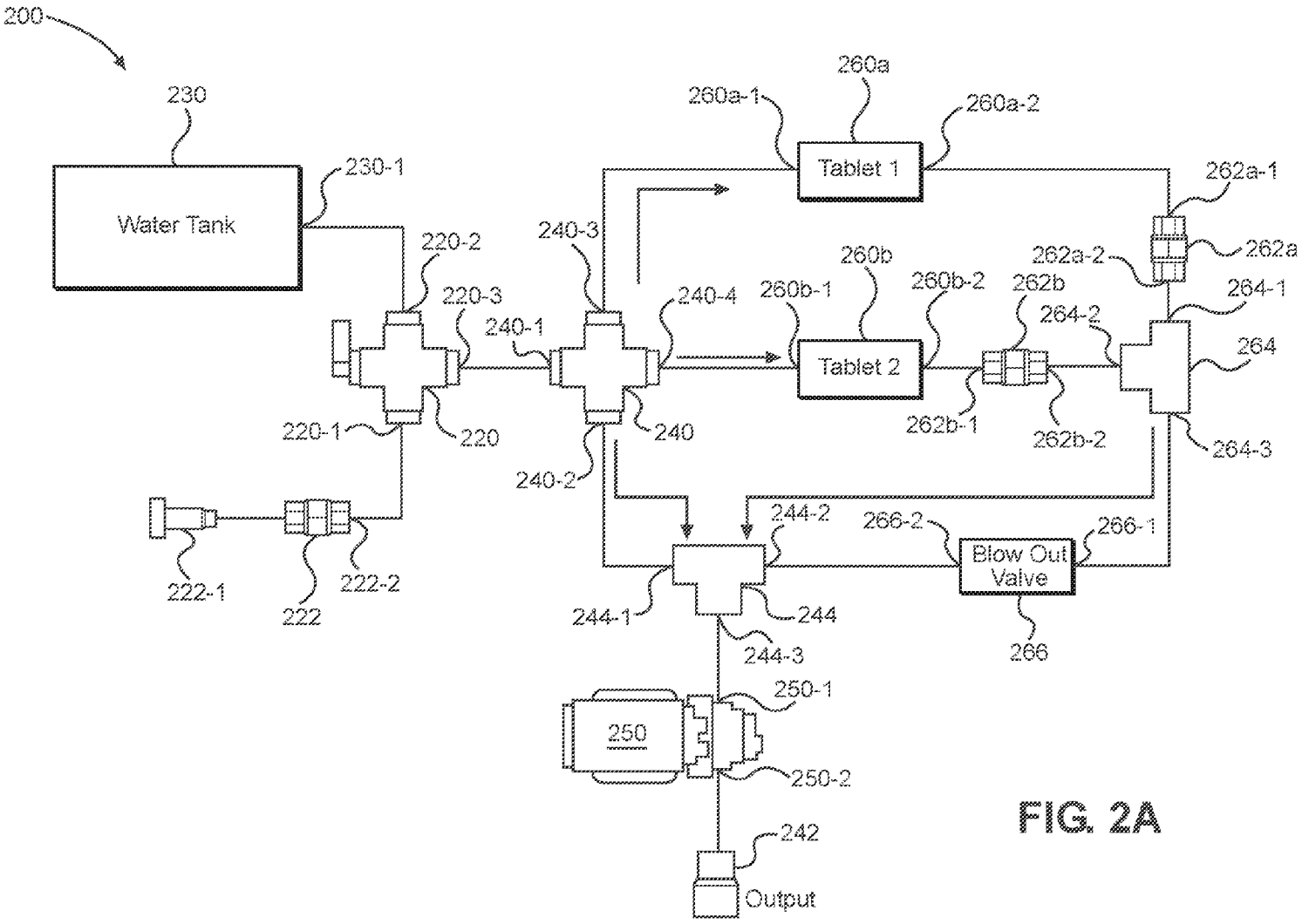
FIG. 2A is a block diagram of hydraulic components of a portable coil cleaning and vacuum system according to some embodiments.
Figure 2B:
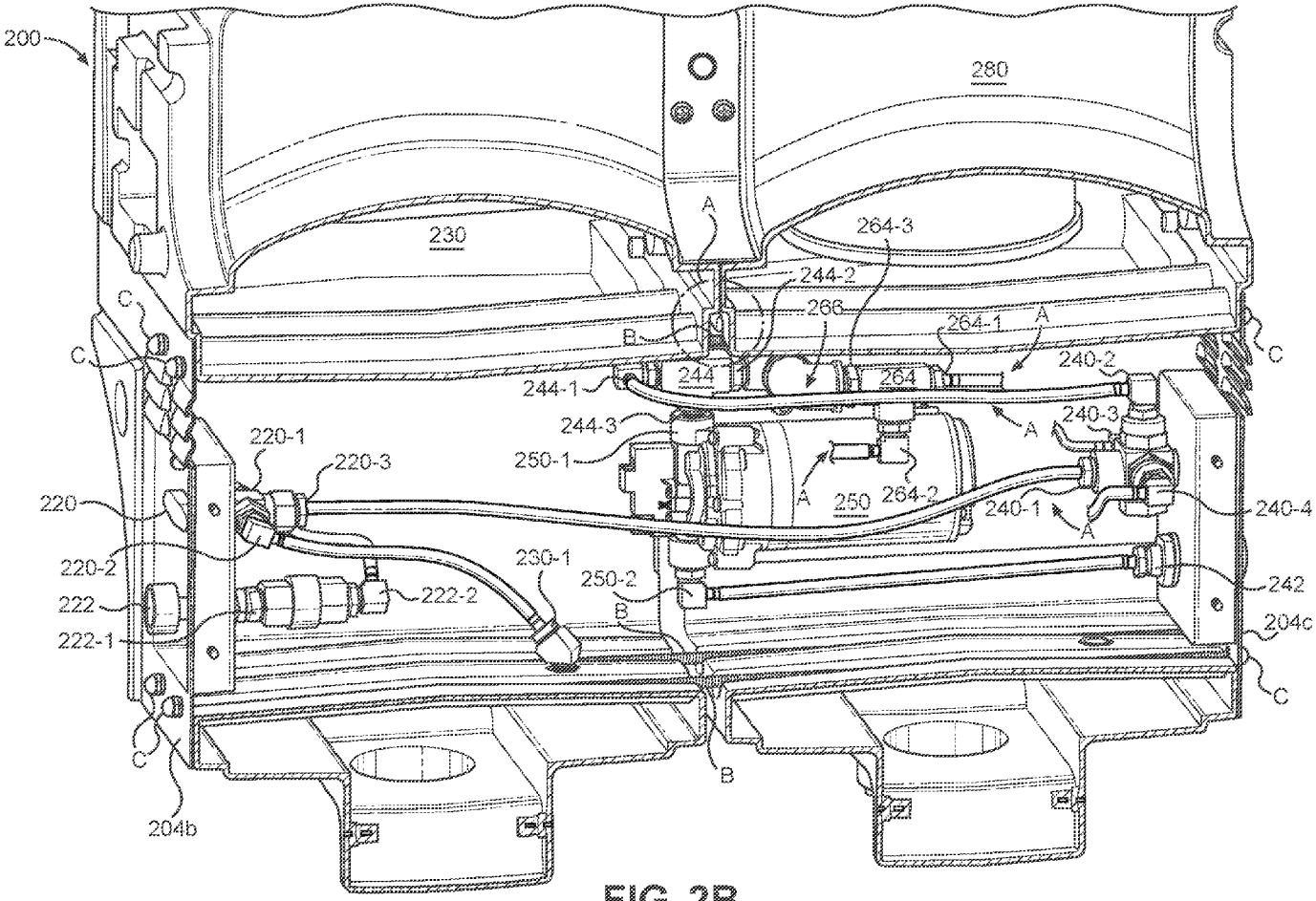
FIG. 2B is a partial cross section view of the portable coil cleaning and vacuum system of FIG. 2A, showing the internal hydraulic components thereof in accordance with some embodiments.

Referring now to FIG. 2A and FIG. 2B, a block diagram of hydraulic components of a portable coil cleaning and vacuum system 200 and a partial cross section view of the portable coil cleaning and vacuum system 200 (showing the internal hydraulic components thereof) according to some embodiments are shown. In some embodiments, the portable coil cleaning and vacuum system 200 may be similar in configuration and/or functionality to the portable coil cleaning and vacuum system 100 of FIG. 1A, FIG. 1B, and/or FIG. 1C. According to some embodiments, the portable coil cleaning and vacuum system 200 may comprise a fluid inlet housing portion 204*b*, a fluid outlet housing portion 204*c*, and/or a fluid supply or first valve 220 (e.g., coupled to and/or retained by the fluid inlet housing portion 204*b*) comprising a first fluid source inlet 220-1, a second fluid source inlet 220-2, and/or a fluid supply outlet 220-3. In some embodiments, the first valve 220 may be selectively engaged to (i) a first position that directs fluid received by the first fluid source inlet 220-1 to the fluid supply outlet 220-3 or (ii) a second position that directs fluid received by the second fluid source inlet 220-2 to the fluid supply outlet 220-3.

In some embodiments, the first fluid source inlet 220-1 may be coupled to an external fluid supply inlet 222. The external fluid supply inlet 222 may comprise, for example, a hose adapter 222-1 (e.g., for accepting and/or coupling to a standardized hose and/or coupling of an external fluid supply source; not shown) and/or a fluid supply port 222-2. The external fluid supply inlet 222 may, in some embodiments, be coupled to the external fluid supply via the hose adapter 222-1 and direct received fluid flow (e.g., pressurized fluid flow) through the fluid supply port 222-2 and to the first fluid source inlet 220-1 of the first valve 220. While many of the connections and/or hydraulic couplings depicted in FIG. 2B are show as tubes or hoses, they are not separately labeled or described, as various types, configurations, and/or quantities of such fluid conduits may be utilized without deviating from the scope of the embodiments described herein. Nor are various possible conduit coupling mechanisms depicted, although in conjunction with the barbed-style fitting shown in FIG. 2B, the conduits would typically be secured to the barbed-style fittings with one or more clasps or clamps, such as a standard and appropriately-sized hose stainless steel hose clamp (not shown).

According to some embodiments, the second fluid source inlet 220-2 of the first valve 220 may be coupled to a water tank 230. The water tank 230 may comprise, for example, a water tank outlet 230-1 disposed near a bottom portion of the water tank 230, such that pressurized water is provided to the second fluid source inlet 220-2. In some embodiments, the first valve 220, the external fluid supply inlet 222, and/or the water tank outlet 230-1 (and/or various hydraulic connections and/or conduits, as depicted) may be disposed and/or housed within a water tank cavity 236 around which the water tank 230 is formed and/or disposed and/or which is defined by the shape of the water tank 230.

In some embodiments, fluid received from either (or both) of the external fluid supply inlet 222 and the water tank 230 may be directed, by the first valve 220 and/or the fluid supply outlet 220-3 thereof, to a second valve 240. The second valve 240 may comprise, for example, a fluid diversion inlet 240-1 coupled to receive fluid from the fluid supply outlet 220-3. According to some embodiments, the second valve 240 may comprise a diversion, mixing, and/or three-way valve. The second valve 240 may, for example, accept and/or receive fluid flow from via the fluid diversion inlet 240-1 and selectively distribute and/or apportion the fluid flow to a rinse diversion outlet 240-2, a first chemical tablet diversion outlet 240-3, and/or a second chemical tablet diversion outlet 240-4. According to some embodiments, the second valve 240 may be selectively engaged at a first position and/or setting that directs fluid flow received by the fluid diversion inlet 240-1 to the rinse diversion outlet 240-2, and ultimately to a fluid outlet 242 (e.g., coupled to and/or retained by the fluid outlet housing portion 204*c*).

The rinse diversion outlet 240-2 may, in some embodiments, be coupled to a first junction, manifold, and/or T-fitting 244 that accepts the fluid flow from the rinse diversion outlet 240-2 via a rinse inlet 244-1. In some embodiments, the first T-fitting 244 may also accept fluid flow via a chemical solution inlet 244-2. Any fluid flow having originated from the first chemical tablet diversion outlet 240-3 and/or a second chemical tablet diversion outlet 240-4, and having been directed through various components thereafter (described in detail below) may be received by the first T-fitting 244 via the chemical solution inlet 244-2.

According to some embodiments, the first T-fitting 244 may direct any fluid flows received via either or both of the rinse inlet 244-1 and the chemical solution inlet 244-2 to a mixed flow outlet 244-3. In some embodiments, the mixed flow outlet 244-3 may direct fluid flow to a fluid pump 250 via a fluid pump inlet 250-1. In some embodiments, the fluid pump 250 may comprise a chemically-resistive pump operable to effectuate negative pressure lift. The fluid pump 250 may, in some embodiments, be configured to provide and/or manage a flow rate of five gallons per minute (5 GPM) and/or operate at and/or provide a pressure of up to six hundred pounds per square inch (600 psi). In some embodiments, the flow rate of the fluid pump 250 may be in the range of one quarter of a gallon per minute (0.25 GPM) to one gallon per minute (1 GPM) and/or the pressure of the fluid pump 250 may be in the range of one hundred pounds per square inch (100 psi) to three hundred pounds per square inch (300 psi). In some embodiments, the fluid pump 250 may direct the fluid (e.g., pressurized fluid) via a pump outlet 250-2 to the fluid outlet 242. Various hoses, fittings, and/or accessories such as extension wands and/or nozzles (not shown) may be coupled to the fluid outlet 242 to utilize the pressurized fluid for rinsing, chemical solution application/washing, or power-washing applications (e.g., to rinse and/or treat HVAC coils). In some embodiments, for example, an accessory fitting such as specialized cleaning wand (not shown) may be coupled to one or more hoses or extensions that in turn are coupled to receive pressurized fluid from the fluid outlet 242 such as to remove debris from heat exchanger coils or fins.

According to some embodiments, the second valve 240 may be selectively engaged at a second position and/or setting that directs fluid flow received by the fluid diversion inlet 240-1 to the first chemical tablet diversion outlet 240-3. In some embodiments, the second valve 240 may be selectively engaged at a third position and/or setting that directs fluid flow received by the fluid diversion inlet 240-1 to the second chemical tablet diversion outlet 240-4. The first chemical tablet diversion outlet 240-3 may direct fluid flow to a first chemical tablet chamber 260*a* via a first chemical tablet chamber inlet 260*a*-1, for example, and the second chemical tablet diversion outlet 240-4 may direct fluid flow to a second chemical tablet chamber 260*b* via a second chemical tablet chamber inlet 260*b*-1. As depicted in FIG. 2B, the chemical tablet chambers 260*a-b* and/or the respective chemical tablet chamber inlets 260*a*-1, 260*b*-1 may be disposed and/or coupled outside of the water tank cavity 236 and/or otherwise outside of the cross sectional view of FIG. 2B. In some embodiments, as depicted, the fluid conduits connecting the second valve 240 to the chemical tablet chambers 260*a-b* may be directed through a passage "A" that leads to the chemical tablet chambers 260*a-b*.

In some embodiments, fluid flow provided to the chemical tablet chambers 260*a-b* may be utilized to dissolve chemical tablets (not shown) to define and/or cause a creation of a chemical cleaning solution and/or agent. According to some embodiments, different chemical tablets may be utilized in the different chemical tablet chambers 260*a-b*, to produce different chemical cleaning solutions and/or agents in each chemical tablet chamber 260*a-b*. In some embodiments, the chemical solution/agent effluent from the first chemical tablet chamber 260*a* may be directed, via a first chemical tablet chamber outlet 260*a*-2, to a first check valve 262*a* and/or the chemical solution/agent effluent from the second chemical tablet chamber 260*b* may be directed, via a second chemical tablet chamber outlet 260*b*-2, to a second check valve 262*b*. According to some embodiments, the first check valve 262*a* may accept a first cleaning solution from the first chemical tablet chamber 260*a* via a first check valve inlet 262*a*-1 and provide unidirectional cleaning solution flow to a first check valve outlet 262*a*-2. In some embodiments, the second check valve 262*b* may accept a second cleaning solution from the second chemical tablet chamber 260*b* via a second check valve inlet 262*b*-1 and provide unidirectional cleaning solution flow to a second check valve outlet 262*b*-2.

According to some embodiments, the first check valve outlet 262*a*-2 may direct the first cleaning solution flow to a second junction, manifold, and/or T-fitting 264. In some embodiments, the second check valve outlet 262*b*-2 may also or alternatively direct the second cleaning solution flow to the second T-fitting 264. The second T-fitting 264 may, for example, accept and/or receive the first cleaning solution flow via a first cleaning solution inlet 264-1 and/or may accept and/or receive the second cleaning solution flow via a second cleaning solution inlet 264-2. As depicted in FIG. 2*b*, the fluid conduits from the check valve outlets 262*a*-2, 262*b*-2 to the second T-fitting 264 may be directed through and/or emanate from the passage "A". In some embodiments, the second T-fitting 264 may direct the combined cleaning solution flow (or individual cleaning solution flows, depending upon what flow is provided from the chemical tablet chambers 260*a-b*) to a chemical mixing outlet 264-3. According to some embodiments, the chemical mixing outlet 264-3 may be coupled to direct the cleaning solution flow(s) to a blow-out valve 266. The cleaning solution flow from the chemical mixing outlet 264-3 may be received by a blow-out inlet 266-1, for example, and provided to a blow-out outlet 266-2. According to some embodiments, the blow-out outlet 266-2 may provide the cleaning solution flow to the chemical solution inlet 244-2 of the first T-fitting 244, and thus onward to the (chemically-resistive) pump 250 and/or the fluid outlet 242.

In some embodiments, the fluid outlet 242, the first T-fitting 244, the pump 250, the second T-fitting 264, the blow-out valve 266 (and/or various hydraulic connections and/or conduits, as depicted) may be disposed and/or housed within and/or by a vacuum canister or tank 280. The vacuum tank 280 may define a vacuum tank cavity 286 around which the vacuum tank 280 is formed and/or disposed and/or which is defined by the shape of the vacuum tank 280. In such a manner, for example, many or all of the hydraulic components of the portable coil cleaning and vacuum system 200 may be protected within one or more of the water tank cavity 236 and the vacuum tank cavity 286, reducing the likelihood of damage, reducing exposure to the elements, and providing a convenient and efficient form factor for portability of the portable coil cleaning and vacuum system 200. According to some embodiments, such as depicted in FIG. 2B, the water tank 230 and the vacuum tank 280 may be coupled or joined such that the interior volumes defined by the water tank cavity 236 and the vacuum tank cavity 286 are volumetrically coupled (e.g., to form one continuous and/or combined cavity; not separately labeled). The coupling of the two tanks 230, 280 may, in some embodiments, form and/or define the passage "A". As depicted in FIG. 2B, the two tanks 230, 280 may be joined by a plurality of threaded rods "B" retained by nuts "C" engaged with the fluid inlet housing portion 204*b* and the fluid outlet housing portion 204*c*.

According to some embodiments, any or all of the components 204*b*, 204*c*, 220, 220-1, 220-2, 220-3, 222, 222-1, 222-2, 230, 230-1, 236, 240, 240-1, 240-2, 240-3, 240-4, 242, 244, 244-1, 244-2, 244-3, 250, 250-1, 250-2, 260*a-b*, 260*a*-1, 260*b*-1, 260*a*-2, 260*b*-2, 262*a-b*, 262*a*-1, 262*b*-1, 262*a*-2, 262*b*-2, 264, 264-1, 264-2, 264-3, 266, 266-1, 266-2, 280, 286 of the portable coil cleaning and vacuum system 200 may be similar in configuration and/or functionality to any similarly named and/or numbered components described herein. Fewer or more components 204*b*, 204*c*, 220, 220-1, 220-2, 220-3, 222, 222-1, 222-2, 230, 230-1, 236, 240, 240-1, 240-2, 240-3, 240-4, 242, 244, 244-1, 244-2, 244-3, 250, 250-1, 250-2, 260*a-b*, 260*a*-1, 260*b*-1, 260*a*-2, 260*b*-2, 262*a-b*, 262*a*-1, 262*b*-1, 262*a*-2, 262*b*-2, 264, 264-1, 264-2, 264-3, 266, 266-1, 266-2, 280, 286 (and/or portions thereof) and/or various configurations of the components 204*b*, 204*c*, 220, 220-1, 220-2, 220-3, 222, 222-1, 222-2, 230, 230-1, 236, 240, 240-1, 240-2, 240-3, 240-4, 242, 244, 244-1, 244-2, 244-3, 250, 250-1, 250-2, 260*a-b*, 260*a*-1, 260*b*-1, 260*a*-2, 260*b*-2, 262*a-b*, 262*a*-1, 262*b*-1, 262*a*-2, 262*b*-2, 264, 264-1, 264-2, 264-3, 266, 266-1, 266-2, 280, 286 may be included in the portable coil cleaning and vacuum system 200 without deviating from the scope of embodiments described herein. In some embodiments, one or more of the various components 204*b*, 204*c*, 220, 220-1, 220-2, 220-3, 222, 222-1, 222-2, 230, 230-1, 236, 240, 240-1, 240-2, 240-3, 240-4, 242, 244, 244-1, 244-2, 244-3, 250, 250-1, 250-2, 260*a-b*, 260*a*-1, 260*b*-1, 260*a*-2, 260*b*-2, 262*a-b*, 262*a*-1, 262*b*-1, 262*a*-2, 262*b*-2, 264, 264-1, 264-2, 264-3, 266, 266-1, 266-2, 280, 286 may not be needed and/or desired in the portable coil cleaning and vacuum system 200.

Figure 3:
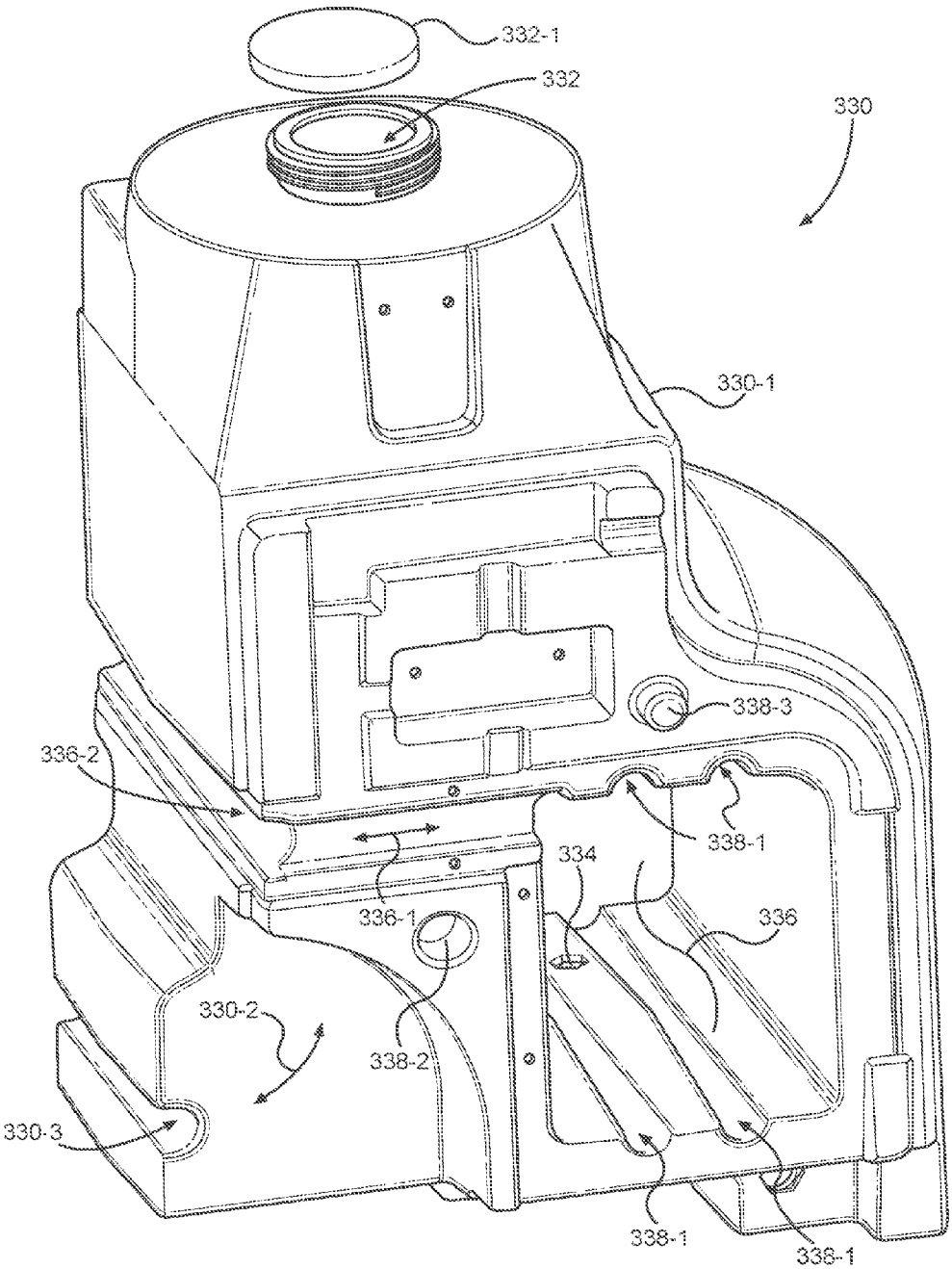
FIG. 3 is an upper, right-rear perspective view of a fluid storage tank according to some embodiments.

Turning now to FIG. 3, an upper, right-rear perspective view of a fluid storage tank 330 according to some embodiments is shown. The fluid storage tank 330 may, for example, be similar in size, shape, configuration, and/or functionality to the water tanks 130, 230 of FIG. 1A, FIG. 1B, FIG. 1C, FIG. 2A, and/or FIG. 2B herein. In some embodiments, the fluid storage tank 330 may comprise a shaped body portion 330-1 that may, for example, comprise an injection-molded and/or otherwise manufactured plastic, polymer, and/or metal body shaped to form various features that may be advantageous to a portable coil cleaning and/or vacuuming system, e.g., as described herein. According to some embodiments, the fluid storage tank 330 and/or the shaped body portion 330-1 thereof may comprise and/or define a wheel recess 330-2 and/or an axle passage 330-3. The wheel recess 330-2 may, for example, comprise a portion of the fluid storage tank 330 that is recessed to accommodate all or a portion of a thickness/width of a wheel (not shown in FIG. 3; e.g., the wheel 112 of FIG. 1A, FIG. 1B, and/or FIG. 1C). In some embodiments, the axle passage 330-3 may comprise a concave, cylindrical, and/or tube-shaped void or indent in the fluid storage tank 330 that is positioned to accept and/or retain an axle (not shown) upon which the wheel is mounted.

According to some embodiments, the fluid storage tank 330 and/or the shaped body portion 330-1 may comprise and/or define an opening 332. The opening 332 may be formed at the top of the shaped body portion 330-1, for example, and/or may be utilized to accept fluid (e.g., water) piped and/or poured into the interior volume (not explicitly shown) of the fluid storage tank 330. In some embodiments, such as depicted in FIG. 3, the opening 332 may be selectively closed or sealed by engagement of a removable cap 332-1 (e.g., threaded, as-shown). According to some embodiments, water or other fluid stored in the fluid storage tank 330 may be removed from the fluid storage tank 330 via a fluid outlet 334. The fluid outlet 334 may be disposed at or near a bottom portion of the fluid storage tank 330 as shown, such as to provide for hydraulic head at the fluid outlet 334.

In some embodiments, the fluid storage tank 330 and/or the shaped body portion 330-1 may define a tank cavity 336. The shaped body portion 330-1 may, for example, be formed around the tank cavity 336 such that the interior volume of the fluid storage tank 330 is transected by the portion of the shaped body portion 330-1 that defines the tank cavity 336. In some embodiments, the tank cavity 336 may be utilized to mount, retain, and/or house various components (not shown) of a portable coil cleaning and vacuum system such as hydraulic components and/or connections thereof. According to some embodiments, the shaped body portion 330-1 may comprise one or more functional passages 336-1,

336-2. A first functional passage 336-1 may, for example, comprise an indent and/or recess that spans between the tank cavity 336 and a second functional passage 336-2. In such a manner, for example, a continuous volume may be established between the second functional passage 336-2 and the tank cavity 336. In some embodiments, such as in the case that the fluid storage tank 330 is coupled side-to-side with another fluid storage tank 330 (not separately shown), corresponding first functional passages 336-1 of the two fluid storage tanks 330 may cooperate to form a passage such as the passage "A" of FIG. 2B. Such a passage may, for example, permit hydraulic conduits to be routed from the tank cavity 336 to the second functional passage 336-2. In some embodiments, the second functional passage 336-2 may be utilized to provide a passageway for hydraulic connections and/or conduits to and/or from one or more chemical tablet containers (not shown in FIG. 3). In such a manner, for example, chemical tablet containers may be hydraulically joined to other components housed within the tank cavity 336.

According to some embodiments, the fluid storage tank 330 and/or the shaped body portion 330-1 may comprise a plurality of tank coupling features 338-1, 338-2, 338-3. A first tank coupling feature 338-1 may comprise one or more grooves, channels, and/or concave indentations in the ceiling and/or floor of the tank cavity 336, for example, such as to accept one or more threaded rods (not shown; e.g., the threaded rods "B" of FIG. 2B). The first tank coupling features 338-1 may be cooperative to accept a plurality of threaded rods that are utilized, for example, to join, mate, and/or couple a plurality of fluid storage tanks 330 (only one being depicted in FIG. 3). In some embodiments, a second tank coupling feature 338-2 may comprise a detent or catch feature and/or a third tank coupling feature 338-3 may comprise a projection, peg, or latch feature. The second tank coupling feature 338-2 or detent depicted on the right side of the fluid storage tank 330 in FIG. 3, for example, may be cooperative with a corresponding third tank coupling feature 338-3 or projection on an adjacent fluid storage tank 330, for example, such that the two corresponding features cooperate to mate, join, and/or couple upon engagement of the right side of the fluid storage tank 330 (shown) with a left side of an adjacent fluid storage tank 330 (not shown in FIG. 3). Similarly, the third tank coupling feature 338-3 or projection depicted on the right side of the fluid storage tank 330 in FIG. 3, for example, may be cooperative with a corresponding second tank coupling feature 338-2 or detent on an adjacent fluid storage tank 330, for example, such that the two corresponding features cooperate to mate, join, and/or couple upon engagement of the right side of the fluid storage tank 330 (shown) with a left side of an adjacent fluid storage tank 330 (not shown in FIG. 3).

According to some embodiments, any or all of the components 330-1, 330-2, 330-3, 332, 332-1, 334, 336, 336-1, 336-2, 338-1, 338-2, 338-3 of the fluid storage tank 330 may be similar in configuration and/or functionality to any similarly named and/or numbered components described herein. Fewer or more components 330-1, 330-2, 330-3, 332, 332-1, 334, 336, 336-1, 336-2, 338-1, 338-2, 338-3 (and/or portions thereof) and/or various configurations of the components 330-1, 330-2, 330-3, 332, 332-1, 334, 336, 336-1, 336-2, 338-1, 338-2, 338-3 may be included in the fluid storage tank 330 without deviating from the scope of embodiments described herein. In some embodiments, one or more of the various components 330-1, 330-2, 330-3, 332, 332-1, 334, 336, 336-1, 336-2, 338-1, 338-2, 338-3 may not be needed and/or desired in the fluid storage tank 330.

Figure 4A:
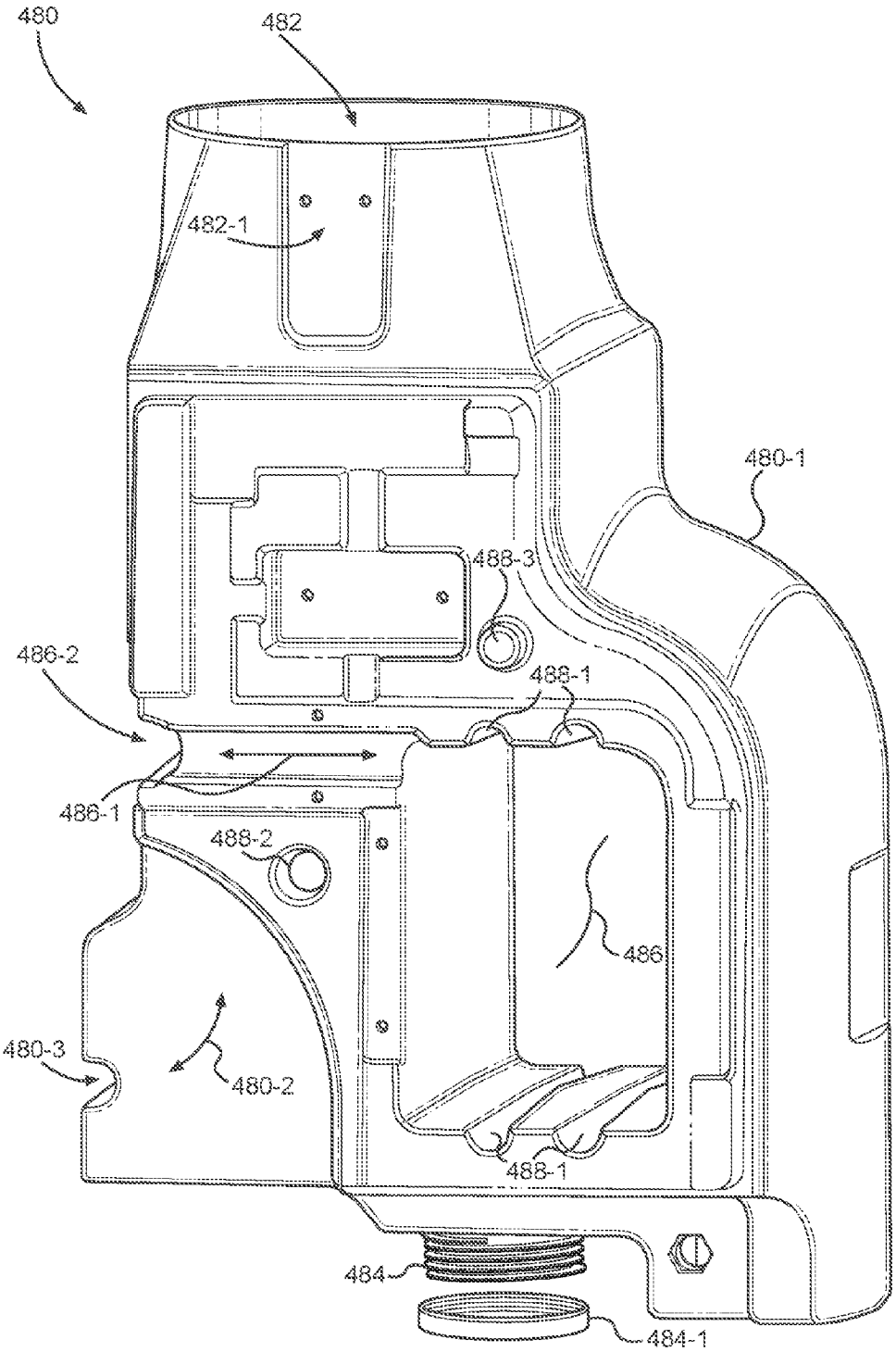
FIG. 4A is front-right perspective view of a vacuum storage tank according to some embodiments.
Figure 4B:
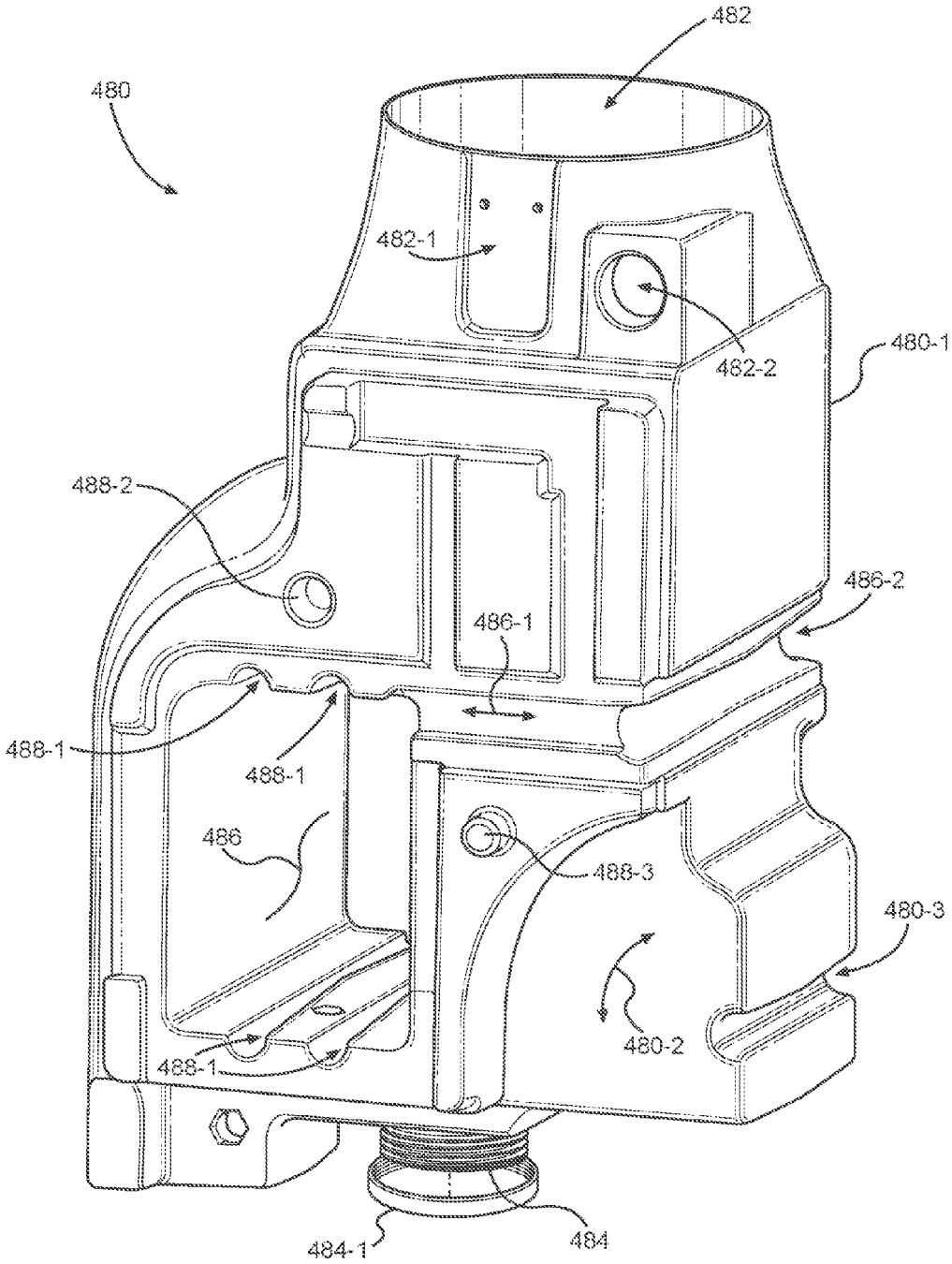
FIG. 4B is left-rear perspective view of the vacuum storage tank of FIG. 4A.

Referring now to FIG. 4A and FIG. 4B, a front-right perspective view and a left-rear perspective view, respectively, of a vacuum storage tank 480 according to some embodiments are shown. The vacuum canister or vacuum storage tank 480 may, for example, be similar in size, shape, configuration, and/or functionality to the water tanks 130, 230, the fluid storage tank 330, and/or the vacuum tank 180 of FIG. 1A, FIG. 1B, FIG. 1C, FIG. 2A, FIG. 2B, and/or FIG. 3 herein. According to some embodiments, the vacuum storage tank 480 may comprise a shaped body portion 480-1 that may, for example, comprise an injection-molded and/or otherwise manufactured plastic, polymer, and/or metal body shaped to form various features that may be advantageous to a portable coil cleaning and/or vacuuming system, e.g., as described herein. In some embodiments, the shaped body portion 480-1 may be the same size and/or shape as the shaped body portion 330-1 of the fluid storage tank 330 of FIG. 3. In some embodiments, for example, both the fluid storage tank 330 and the vacuum storage tank 480 may be manufactured as the same shaped body portion 330-1, 480-1, with only minor modifications (described below) needed to utilize the manufactured unit as either a fluid storage tank 330 or a vacuum storage tank 480.

According to some embodiments, the vacuum storage tank 480 and/or the shaped body portion 480-1 may comprise and/or define a wheel recess 480-2 and/or an axle groove or seat 480-3. As depicted in FIG. 4A and FIG. 4B, the wheel recess 480-2 may be formed on both sides (left and right) of the vacuum storage tank 480 such that regardless of whether the vacuum storage tank 480 is utilized as a right or left member in a two (or more) tank arrangement/grouping, a wheel recess 480-2 may be properly oriented to each outside edge of a portable coil cleaning and vacuum system such that at least two wheels (not shown in FIG. 4A or FIG. 4B) may readily be recessed in appropriate corresponding wheel recesses 480-2. In some embodiments, an axle (not shown) connecting the two or more wheels may be disposed in and/or retained by the axle seat 480-3.

In some embodiments, the vacuum storage tank 480 and/or the shaped body portion 480-1 may comprise and/or define an opening 482 into an interior volume (not separately labeled) of the vacuum storage tank 480. In some embodiments, the opening 482 may comprise a substantial portion of an upper circular surface of the shaped body portion 480-1. As opposed to the smaller, threaded opening 332 depicted with respect to the fluid storage tank 330 of FIG. 3 that includes only a small portion of the upper circular surface, for example, the opening 482 may comprise a larger opening extending substantially from one side of the upper circular surface to the other, such as to accept a cooperatively-sized vacuum unit (not shown in FIG. 4A or FIG. 4B). In such embodiments, the manufactured shaped body portion 480-1 may comprise the shaped body portion 330-1 of FIG. 3, but may subsequently have the upper surface substantially cut out or removed to define the opening 482.

According to some embodiments, the vacuum storage tank 480 and/or the shaped body portion 480-1 may comprise and/or define a latch recess 482-1 operable to receive a latch assembly (not shown in FIG. 4A or FIG. 4B) that is cooperative with the vacuum unit to secure the vacuum unit to the upper surface of the vacuum storage tank 480 and/or the shaped body portion 480-1. In some embodiments, vacuum storage tank 480 and/or the shaped body portion 480-1 may comprise and/or define a vacuum port 482-2. The vacuum port 482-2 may be formed into the shaped body portion 480-1 to define a second, smaller opening into the interior volume of the vacuum storage tank 480. In the case that the vacuum unit (not shown) is disposed to cover the opening 482, for example, the vacuum unit may cause a suction force to be generated at the vacuum port 482-2. In such embodiments, the manufactured shaped body portion 480-1 may comprise the shaped body portion 330-1 of FIG. 3, but may subsequently have the vacuum port 482-2 cut out of or bored into the shaped body portion 480-1.

In some embodiments, the vacuum storage tank 480 and/or the shaped body portion 480-1 may comprise a vacuum tank drain 484 disposed and/or cut into the bottom of the vacuum storage tank 480 and/or the shaped body portion 480-1. The vacuum tank drain 484 may, in some embodiments, be selectively sealed by engagement of a removable cap 484-1. In such embodiments, the manufactured shaped body portion 480-1 may comprise the shaped body portion 330-1 of FIG. 3, but may subsequently have the vacuum tank drain 484 cut out of or bored into the shaped body portion 480-1.

According to some embodiments, the vacuum storage tank 480 and/or the shaped body portion 480-1 may define a tank cavity 486. The shaped body portion 480-1 may, for example, be formed around the tank cavity 486 such that the interior volume of the vacuum storage tank 480 is transected by the portion of the shaped body portion 480-1 that defines the tank cavity 486. In some embodiments, the tank cavity 486 may be utilized to mount, retain, and/or house various components (not shown) of a portable coil cleaning and vacuum system such as hydraulic components and/or connections thereof. According to some embodiments, the shaped body portion 480-1 may comprise one or more functional passages 486-1, 486-2. A first functional passage 486-1 may, for example, comprise an indent and/or recess that spans between the tank cavity 486 and a second functional passage 486-2. In such a manner, for example, a continuous volume may be established between the second functional passage 486-2 and the tank cavity 486. In some embodiments, such as in the case that the vacuum storage tank 480 is coupled side-to-side with another tank (not separately shown in FIG. 4A or FIG. 4B; e.g., the fluid storage tank 330 of FIG. 3), corresponding first functional passages 486-1, 336-1 of the two tanks 480, 330 may cooperate to form a passage such as the passage "A" of FIG. 2B. Such a passage may, for example, permit hydraulic conduits to be routed from the tank cavity 486 to the second functional passage 486-2. In some embodiments, the second functional passage 486-2 may be utilized to provide a passageway for hydraulic connections and/or conduits to and/or from one or more chemical tablet containers (not shown in FIG. 4A or FIG. 4B). In such a manner, for example, chemical tablet containers may be hydraulically joined to other components housed within the tank cavity 486.

According to some embodiments, the vacuum storage tank 480 and/or the shaped body portion 480-1 may comprise a plurality of tank coupling features 488-1, 488-2, 488-3. A first tank coupling feature 488-1 may comprise one or more grooves, channels, and/or concave indentations in the ceiling and/or floor of the tank cavity 486, for example, such as to accept one or more threaded rods (not shown; e.g., the threaded rods "B" of FIG. 2B). The first tank coupling features 488-1 may be cooperative to accept a plurality of threaded rods that are utilized, for example, to join, mate, and/or couple a plurality of vacuum storage tanks 480 (and/or fluid storage tanks 330; only one being depicted in FIG. 4A and FIG. 4B). In some embodiments, a second tank coupling feature 488-2 may comprise a detent or catch feature and/or a third tank coupling feature 488-3 may comprise a projection, peg, or latch feature. The second tank coupling feature 488-2 or detent depicted on the left side of the vacuum storage tank 480 in FIG. 4B, for example, may be cooperative with a corresponding third tank coupling feature 488-3, 338-3 or projection on an adjacent tank 480, 330, as depicted in FIG. 3 for example, such that the two corresponding features 488-2, 338-3 cooperate to mate, join, and/or couple upon engagement of the right side of the fluid storage tank 330 (shown) with the left side of vacuum storage tank 480. Similarly, the third tank coupling feature 488-3 or projection depicted on the left side of the vacuum storage tank 480 in FIG. 4B, for example, may be cooperative with a corresponding second tank coupling feature 488-2, 338-2 or detent on an adjacent tank 480, 330, as depicted in FIG. 3 for example, such that the two corresponding features cooperate to mate, join, and/or couple upon engagement of the right side of the fluid storage tank 330 (shown in FIG. 3) with the left side of the vacuum storage tank 480—or vice versa.

According to some embodiments, any or all of the components 480-1, 480-2, 480-3, 482, 482-1, 484, 484-1, 486, 486-1, 486-2, 488-1, 488-2, 488-3 of the vacuum storage tank 480 may be similar in configuration and/or functionality to any similarly named and/or numbered components described herein. Fewer or more components 480-1, 480-2, 480-3, 482, 482-1, 484, 484-1, 486, 486-1, 486-2, 488-1, 488-2, 488-3 (and/or portions thereof) and/or various configurations of the components 480-1, 480-2, 480-3, 482, 482-1, 484, 484-1, 486, 486-1, 486-2, 488-1, 488-2, 488-3 may be included in the vacuum storage tank 480 without deviating from the scope of embodiments described herein. In some embodiments, one or more of the various components 480-1, 480-2, 480-3, 482, 482-1, 484, 484-1, 486, 486-1, 486-2, 488-1, 488-2, 488-3 may not be needed and/or desired in the vacuum storage tank 480.

Figure 5A:
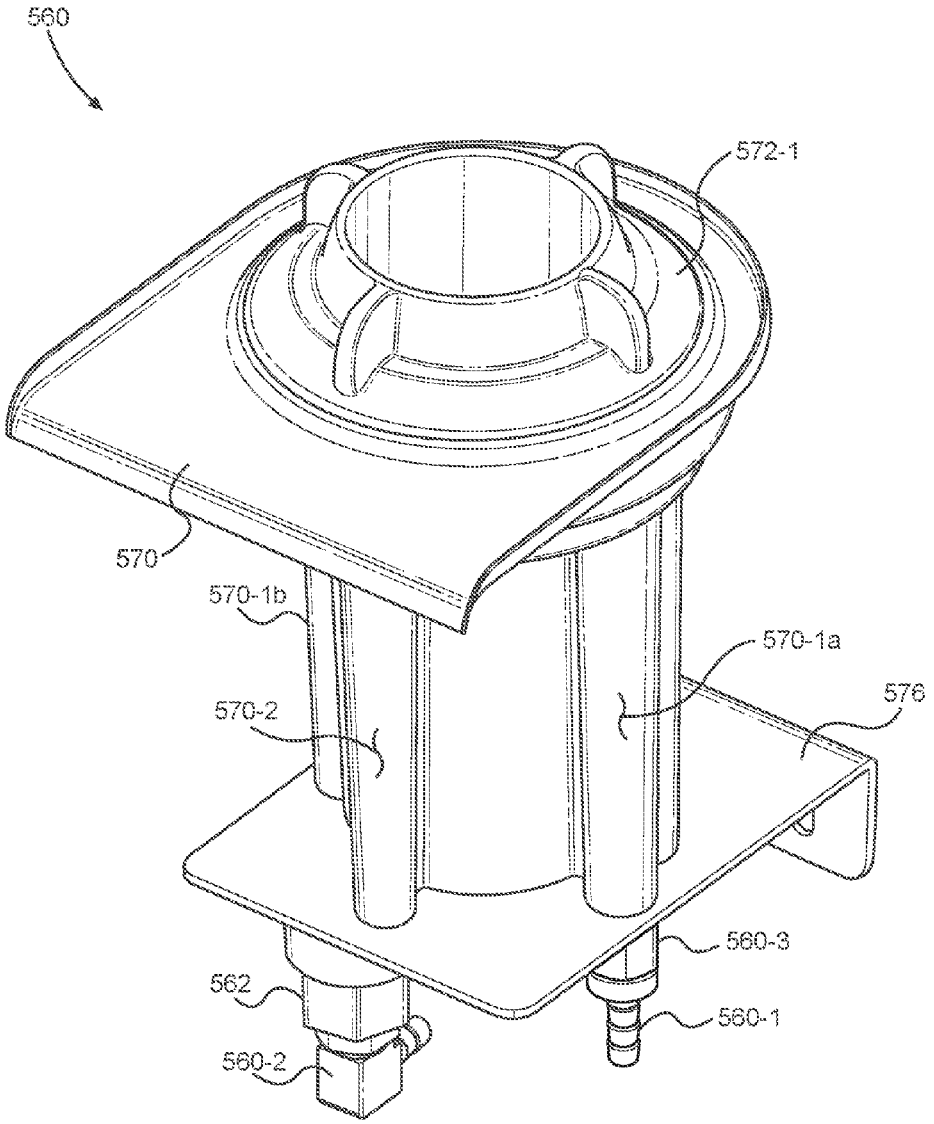
FIG. 5A is an upper, front-left perspective view of a chemical tablet container according to some embodiments.
Figure 5B:
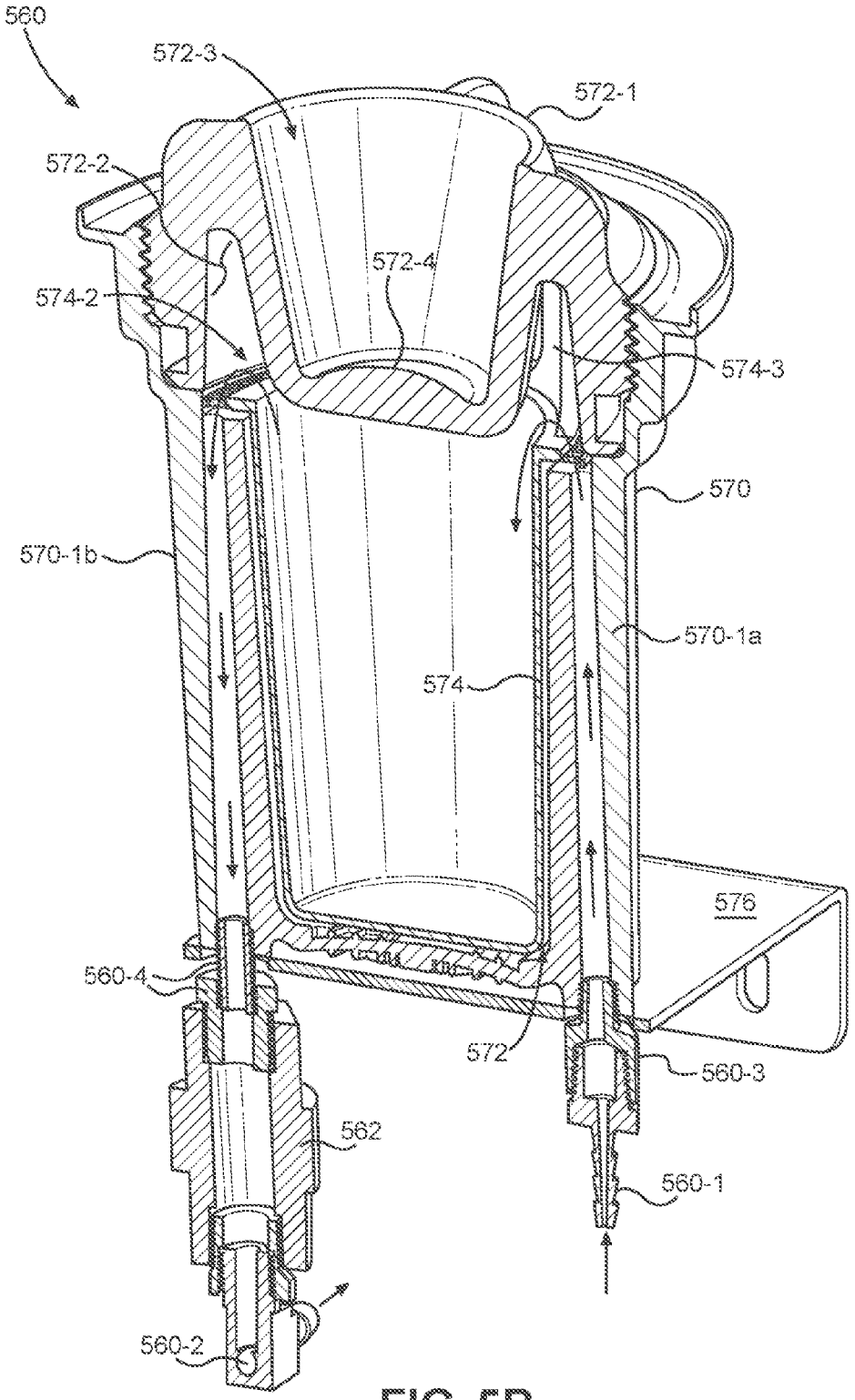
FIG. 5B is an upper, front-left cross section view of the chemical tablet container of FIG. 5A.
Figure 5C:
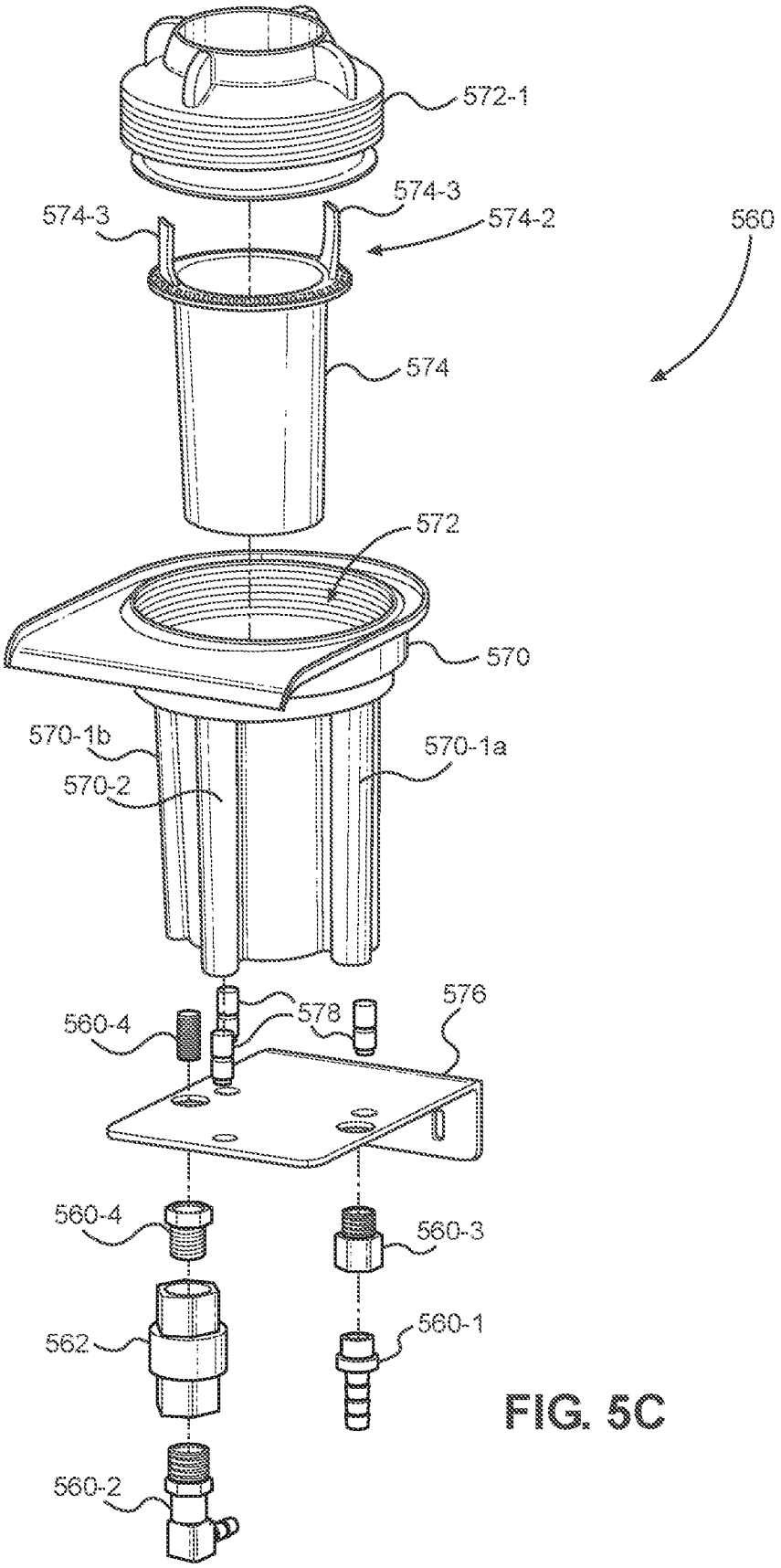
FIG. 5C is an upper, front-left perspective assembly view of the chemical tablet container of FIG. 5A and FIG. 5B.

Turning to FIG. 5A, FIG. 5B, and FIG. 5C, an upper, front-left perspective view, an upper, front-left cross section view, and an upper, front-left perspective assembly view, respectively, of a chemical tablet container 560 according to some embodiments are shown. In some embodiments, the chemical tablet container 560 may comprise and/or define an inlet 560-1 and an outlet 560-2. The inlet 560-1 and/or the outlet 560-2 may comprise a barbed hydraulic fitting (a barbed elbow fitting with respect to the outlet 560-2) as depicted in FIG. 5A, FIG. 5B, and FIG. 5C, for example, or may comprise any other fluid inlet style, type, quantity, and/or configuration that is or becomes known or practicable. In some embodiments, the inlet 560-1 may be coupled to an inlet adapter 560-3 and/or the outlet 560-2 may be coupled to an outlet adapter 560-4. According to some embodiments, the outlet 560-2 may be coupled to a check valve 562, e.g., disposed hydraulically between the outlet 560-2 and the outlet adapter 560-4, such as to prevent reverse flow into the chemical tablet container 560.

In some embodiments, the inlet 560-1 and the outlet 560-2 may be coupled to a chemical tablet canister 570. The inlet 560-1 may be coupled, via the inlet adapter 560-3 for example, to provide fluid flow into the chemical tablet canister 570. According to some embodiments, the outlet 560-2 may be coupled, via the outlet adapter 560-4 for example, to remove fluid flow from the chemical tablet canister 570. In some embodiments, the chemical tablet canister 570 may comprise an inlet conduit 570-1*a* coupled to accept and/or receive fluid flow from the inlet 560-1 (and/or the inlet adapter 560-3) and/or an outlet conduit 570-1*b* coupled to provide and/or transmit fluid flow to the outlet 560-2 (and/or the outlet adapter 560-4). As depicted in FIG. 5A, FIG. 5B, and FIG. 5C, the inlet conduit 570-1*a* and/or the outlet conduit 570-1*b* may comprise projections, legs, supports, and/or ribs formed on and/or coupled to a generally cylindrical body defining the chemical tablet canister 570. According to some embodiments, the chemical tablet canister 570 may comprise one or more additional projections, legs, supports, and/or ribs formed on and/or coupled thereto, such as a plurality of support legs 570-2 (e.g., three (3), as depicted).

According to some embodiments, the chemical tablet canister 570 may define an interior volume 572, into which fluid flow enters via the inlet conduit 570-1*a* and exits via the outlet conduit 570-1*b*. The chemical tablet canister 570 may comprise, for example, a cylindrically-shaped body that is hollow, defining the interior volume 572, and/or that is open at a first end thereof (not separately labeled). According to some embodiments, the open first end may be selectively and/or optionally sealed with a chemical canister cap 572-1. In some embodiments, such as depicted, the chemical canister cap 572-1 may be threaded onto chemical tablet canister 570 and/or into the interior volume 572 at the first open end thereof. While threaded engagement is depicted for purposes of illustration, other coupling mechanisms, particularly those that allow for removable coupling of the chemical canister cap 572-1 to selectively close and open the interior volume 572, may be utilized in some embodiments.

In some embodiments, the chemical canister cap 572-1 may engage with the interior sides of the chemical tablet canister 570 and may form one or more cap voids 572-2 in volumetric communication with the interior volume 572, e.g., in the case that the chemical canister cap 572-1 is engaged to close or seal the interior volume 572. According to some embodiments, the cap voids 572-2 may be formed and/or defined (at least partially) by a center depression 572-3 of the chemical canister cap 572-1. In such a configuration, the cap voids 572-2 may be formed and/or disposed generally along the circumference of the interior volume 572, with the center depression 572-3 extending downward toward and/or at the open end of the interior volume 572. In some embodiments, the center depression 572-3 may house, define, and/or otherwise comprise a window 572-4. The window 527-4 may, for example, comprise a transparent or translucent portion of the center depression 572-3 and/or the chemical canister cap 572-1, which permits visual inspection of the contents of the interior volume 572. In the case that a chemical tablet (not shown) is disposed in the interior volume 572 and exposed to and/or acted upon by fluid flow provided by the inlet conduit 570-1*a*, for example, a state or degree of dissolution of the chemical tablet may be visually monitored via the window 572-4. In some embodiments, alternate or additional chemical tablet indicator means may be utilized, such as those described in cop-pending and commonly-owned U.S. patent application Ser. No. 14/595,730 filed on Jan. 13, 2015 and titled "STAND-ALONE CHEMICAL DISPENSER", the chemical tablet indicator and/or inspection means, concepts, and descriptions of which are hereby incorporated by reference herein.

According to some embodiments, a chemical tablet container, sleeve, basket, or cup 574 may be disposed in the interior volume 572 of the chemical tablet canister 570 (e.g., as depicted in FIG. 5B and FIG. 5C). In some embodiments, the chemical tablet cup 574 may generally comprise a hollow cylindrical body defining an interior cup volume 574-1. According to some embodiments (as depicted), the interior cup volume 574-1 may be open at a first (e.g., upper) end of the chemical tablet cup 574, such that the interior cup volume 574-1 is in volumetric communication with the cap voids 572-2 (e.g., in the case that the chemical tablet cup 574 is inserted into the interior volume 572 and sealed therein by engagement of the chemical canister cap 572-1. According to some embodiments, the chemical tablet cup 574 may provide various operational benefits such as preventing or reducing fluid spillage. In operation, for example, the interior volume 572 will typically fill with water/fluid. Upon dissolution of a chemical tablet (not shown) in the interior volume 572, a new chemical tablet would typically be inserted. In the absence of the chemical tablet cup 574, the new chemical tablet may be inserted directly into the interior volume 572, displacing a corresponding amount of fluid therefrom, such displaced fluid which may accordingly overflow from the interior volume 572 via the open first end thereof. As such displaced fluid may comprise a chemical solution, it may not be desirable to allow spillage thereof. In some embodiments, utilization of the chemical tablet cup 574 may reduce or prevent such spillage. In operation utilizing the chemical tablet cup 574, for example, to add a new chemical tablet, the chemical tablet cup 574 may be removed from the interior volume 572, the chemical tablet cup 574 (or more specifically, the interior cup volume 574-1 thereof) retaining an amount of fluid that would otherwise be disposed within the interior volume 572. The contents of the chemical tablet cup 574 may be appropriately disposed of, one or more new chemical tablets may be inserted into the empty interior cup volume 574-1, and the chemical tablet cup 574 may be re-inserted into the interior volume 572. In such embodiments, the re-insertion of the chemical tablet cup 574 may displace a minimal amount of fluid in the interior volume 572 (as most of the fluid was removed with the chemical tablet cup 574), resulting in little or no spillage of chemical cleaning solution.

In some embodiments, the bottom of the chemical tablet cup 574 may rest upon the bottom of the interior volume 572 when inserted into the chemical tablet canister 570 (e.g., as depicted in FIG. 5B). According to some embodiments, the chemical tablet cup 574 may comprise a perforated lip 574-2 extending around the circumference of the chemical tablet cup 574 at the first, open end thereof. As shown, the perforated lip 574-2 may extend radially outward from the chemical tablet cup 574. In some embodiments, the perforated lip 574-2 may be positioned over one or more of the entrance of the inlet conduit 570-1*a* into the interior volume 572 and the exit of the outlet conduit 570-1*b* from the interior volume 572. In such a manner, for example, and as best illustrated in the cross section view of FIG. 5B, fluid flow may enter the interior volume 572 (and/or the chemical tablet canister 570) via the inlet conduit 570-1*a* that is disposed to provide the fluid flow in a first direction (e.g., upward, as depicted). The perforated lip 574-2 (or a portion thereof) may be positioned in front of the entering fluid flow and the fluid flow may generally be diffused as it passes through the perforated lip 574-2 in the first flow direction. In some embodiments, the fluid flow may be deflected from the first direction by entering into one or more cap voids 572-2 situated in front of the entering and diffused fluid flow. According to some embodiments, the fluid flow may be deflected by the cap void(s) 572-2 into the interior cup volume 574-1, e.g., in a second fluid flow direction that is generally opposite (e.g., downward, as depicted) to the first fluid flow direction.

In such a manner, for example, incoming fluid flow may be diffused and deflected to enter the interior cup volume

574-1 where it may act upon one or more chemical tablets (not shown). Dissolution of the chemical tablet(s) may cause the formation of and/or define a chemical cleaning solution/agent that is forced (by the pressure of the incoming fluid flow) into one or more of the cap voids 572-2 (e.g., a cap void 572-2 opposite the cap void 572-2 via which the incoming fluid flow enters, as depicted). According to some embodiments, the exiting fluid flow may enter the cap void(s) 572-2 in a fluid flow direction similar to the first fluid flow direction (e.g., upward, as depicted). The cap void(s) 572-2 may deflect the exiting fluid flow from the first fluid flow direction to the second fluid flow direction (e.g., downward, as depicted) and through the perforated lip 574-4 and into the outlet conduit 570-1*b*. In such a manner, for example, the perforated lip 574-2 may act as both a pre-filter for incoming fluid flow (e.g., to facilitate removal of incoming particulates, debris, etc.) and a post-filter for exiting chemical solution flow (e.g., to facilitate prevention of larger portions of partially-dissolved chemical tablet from exiting the chemical tablet canister 570. According to some embodiments, the chemical tablet cup 574 may comprise one or more handle projections 574-3 that facilitate removal of the chemical tablet cup 574 from the interior volume 572 of the chemical tablet canister 570. In some embodiments, the handle projections 574-3 may be sized and/or shaped to fit/nest within one or more of the cap voids 572-2 in the case that the chemical tablet cup 574 is disposed in the interior volume 572 and sealed therein by engagement of the chemical canister cap 572-1.

In some embodiments, the chemical tablet canister 570 may be coupled to a mounting bracket 576. Each support leg 570-2 of the chemical tablet canister 570 may, for example, be hollowed out, threaded, and/or otherwise configured to accept and/or retain a mounting screw, rivet, bolt, or pin 578 that is operable to engage or mate with the mounting bracket 576. In such a manner, for example, the chemical tablet canister 570 may be securely coupled to the mounting bracket 576, which may in turn be securely coupled to a portion of a portable coil cleaning and vacuum system (not shown in FIG. 5A, FIG. 5B, or FIG. 5C) such that chemical cleaning solution effluent from dissolved chemical tablets may be provided for coil and/or fin cleaning operations.

According to some embodiments, any or all of the components 560-1, 560-2, 560-3, 560-4, 562, 570, 570-1, 570-1*b*, 570-2, 572, 572-1, 572-2, 572-3, 572-4, 574, 574-1, 574-2, 574-3, 576, 578 of the chemical tablet container 560 may be similar in configuration and/or functionality to any similarly named and/or numbered components described herein. Fewer or more components 560-1, 560-2, 560-3, 560-4, 562, 570, 570-1, 570-1*b*, 570-2, 572, 572-1, 572-2, 572-3, 572-4, 574, 574-1, 574-2, 574-3, 576, 578 (and/or portions thereof) and/or various configurations of the components 560-1, 560-2, 560-3, 560-4, 562, 570, 570-1, 570-1*b*, 570-2, 572, 572-1, 572-2, 572-3, 572-4, 574, 574-1, 574-2, 574-3, 576, 578 may be included in the chemical tablet container 560 without deviating from the scope of embodiments described herein. In some embodiments, one or more of the various components 560-1, 560-2, 560-3, 560-4, 562, 570, 570-1, 570-1*b*, 570-2, 572, 572-1, 572-2, 572-3, 572-4, 574, 574-1, 574-2, 574-3, 576, 578 may not be needed and/or desired in the chemical tablet container 560.

Figure 6:
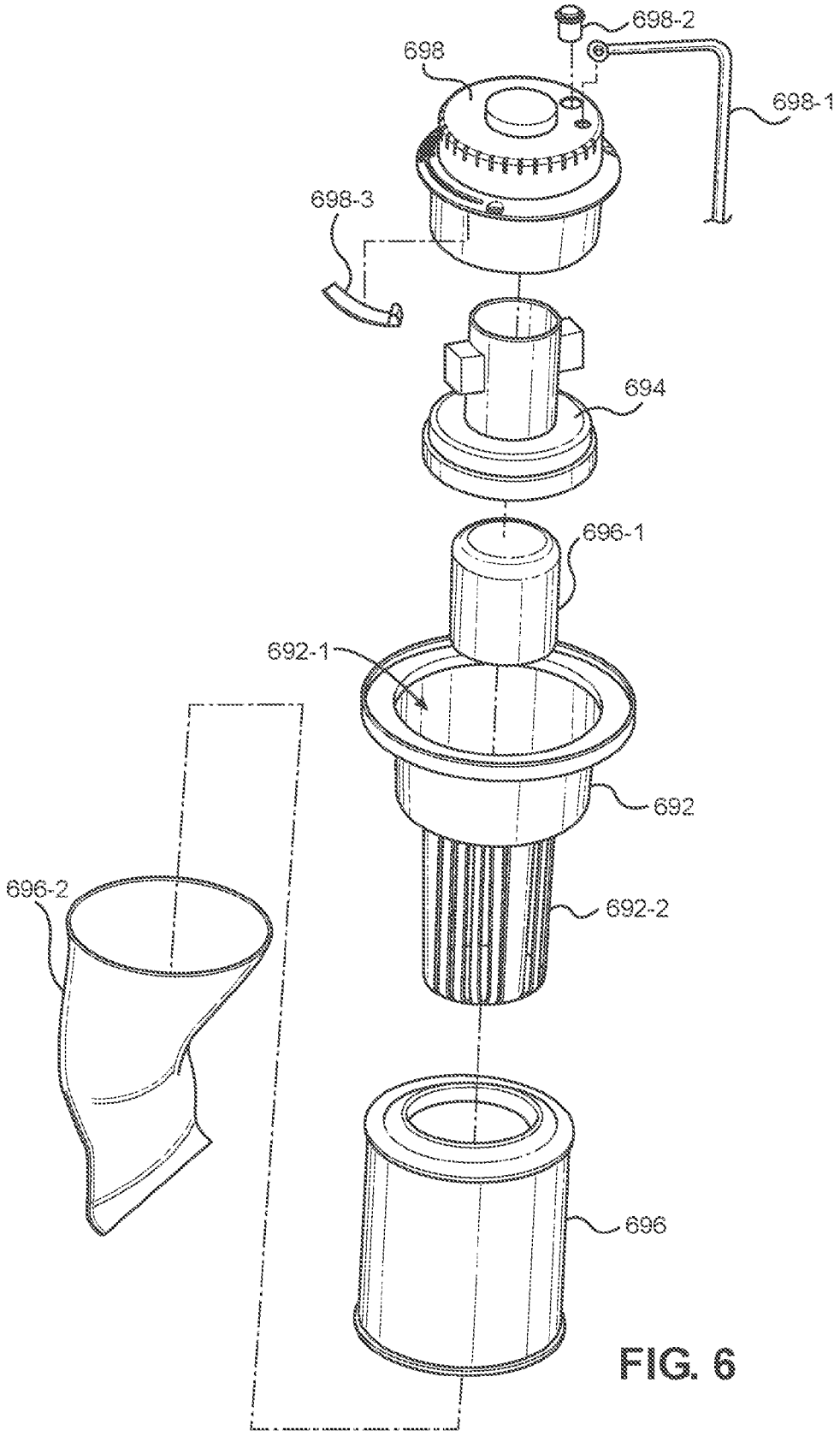
FIG. 6 is an upper, front-left perspective assembly view of a vacuum assembly according to some embodiments.

Turning now to FIG. 6, an upper, front-left perspective assembly view of a vacuum assembly 690 according to some embodiments is shown. The vacuum assembly 690 may, for example, be similar in size, shape, configuration, and/or functionality to the vacuum unit 190 of FIG. 1A, FIG. 1B, and/or FIG. 1C herein. In some embodiments, the vacuum assembly 690 may be sized and/or configured to fit into and/or latch onto a specially-molded and/or manufactured vacuum storage tank (not shown in FIG. 6; e.g., the vacuum storage tank 480 of FIG. 4A and/or FIG. 4B herein). According to some embodiments, the vacuum assembly 690 may comprise a housing 692 defining an interior volume 692-1 and/or a filter cage 692-2. The interior volume 692-1 may, for example, accommodate and/or mate with a vacuum motor unit 694. In some embodiments, the housing 692 may be sized and/or configured to sit within and/or mate with a mounting opening of a vacuum tank (not shown in FIG. 6; e.g., the opening 482 of the vacuum tank 480 of FIG. 4A and/or FIG. 4B herein).

In some embodiments, the filter cage 692-2 may accept and/or nest within a filter element 696 (e.g., a standard hollow cylindrical filter as depicted) and/or may house a float 696-1. The float 696-1 may, for example, rise within the filter cage 692-2 in the case that a water level (e.g., in a vacuum tank in which the vacuum assembly 690 is disposed; not shown in FIG. 6) rises. In some embodiments, the float 696-1 may be sized and/or shaped and/or the filter cage 692-2 may be sized and/or shaped such that in the case the water/fluid level rises to a design threshold level, the float 696-1 may block or impede suction of the vacuum assembly 690; e.g., preventing overflowing due to excessive wet pickup). In some embodiments, a vacuum bag 696-2 may be positioned over the filter element 696, such as to accept and/or collect dry debris picked up by the vacuum assembly 690.

According to some embodiments, the vacuum assembly 690 may comprise a vacuum cover 698 comprising a vacuum power lead 698-1, a power button 698-2, and/or a wet/dry slide switch 698-3. The vacuum cover 698 may, for example, mount on and/or coupled to the vacuum motor unit 694 and/or retain the vacuum motor unit 694 in the interior volume 692-1 of the housing 692. The power button 698-2 may be electrically cooperative with power supplied by the vacuum power lead 698-1 to selectively provide power to activate the vacuum motor unit 694. In some embodiments, the wet/dry slide switch 698-3 may be utilized to change a state or setting of the vacuum assembly 690 to accommodate either wet or dry vacuuming activities, as selectively desired.

According to some embodiments, any or all of the components 692, 692-1, 692-2, 694, 696, 696-1, 696-2, 698, 698-1, 698-2, 698-3 of the vacuum assembly 690 may be similar in configuration and/or functionality to any similarly named and/or numbered components described herein. Fewer or more components 692, 692-1, 692-2, 694, 696, 696-1, 696-2, 698, 698-1, 698-2, 698-3 (and/or portions thereof) and/or various configurations of the components 692, 692-1, 692-2, 694, 696, 696-1, 696-2, 698, 698-1, 698-2, 698-3 may be included in the vacuum assembly 690 without deviating from the scope of embodiments described herein. In some embodiments, one or more of the various components 692, 692-1, 692-2, 694, 696, 696-1, 696-2, 698, 698-1, 698-2, 698-3 may not be needed and/or desired in the vacuum assembly 690.

III. Conclusion

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant(s) reserves the right to file additional applications to pursue patents for subject matter that has been disclosed and enabled, but not claimed in the present application.

What is claimed is:

1. A portable coil cleaning and vacuum system, comprising:

a frame;

a fluid inlet;

a fluid storage tank coupled to the frame;

a first valve coupled to receive fluid from each of the fluid inlet and the fluid storage tank, the first valve being selectively operable to direct fluid received from one of the fluid inlet and the fluid storage tank to a first valve outlet;

a second valve coupled to receive the selected flow from the first valve outlet, the second valve being selectively operable to direct the received fluid to one or more of (i) a fluid pump inlet, via a second valve outlet, (ii) a first chemical tablet container, via a second valve first chemical outlet, and (iii) a second chemical tablet container, via a second valve second chemical outlet;

a first T-fitting coupled to receive fluid flow from each of the first and second chemical tablet containers and to direct received fluid flow to a first T-fitting outlet;

a second T-fitting coupled to receive fluid flow from each of the second valve outlet and the first T-fitting outlet and to direct received fluid flow to the fluid pump inlet;

a fluid pump coupled to receive fluid flow from the fluid pump inlet and to provide the received fluid flow to a fluid outlet, the fluid pump being selectively powered via engagement of a first electrical switch at a first switch position;

the first chemical tablet container; and the second chemical tablet container, each chemical tablet container, comprising:

a cylindrical body defining a plurality of integral support legs, a fluid inlet, and a fluid outlet, with each of the fluid inlet and the fluid outlet being in volumetric communication with an internal cavity defined by the cylindrical body, the internal cavity being open at a first end of the cylindrical body;

a chemical tablet cup removably disposed within the internal cavity, the chemical tablet cup defining an interior void to accept a chemical tablet and a perforated rim defining a volumetric communication between the internal cavity of the cylindrical body and the internal cavity of the chemical tablet cup; and a removable cap coupled to the first end of the cylindrical body to selectively seal the internal cavities at the first end.

2. The portable coil cleaning and vacuum system of claim 1, wherein the fluid storage tank is formed around a fluid storage tank cavity.

3. The portable coil cleaning and vacuum system of claim 2, wherein at least three of the first valve, the second valve, the first T-fitting, the second T-fitting, and the fluid pump are disposed within one or more of the vacuum tank cavity and the fluid storage tank cavity.

4. The portable coil cleaning and vacuum system of claim 1, wherein the vacuum tank and the fluid storage tank are the same size and shape.

5. The portable coil cleaning and vacuum system of claim 1, wherein the removable cap comprises a viewport permitting visual inspection of the internal cavity of the chemical tablet cup in the case that the removable cap is engaged to close the internal cavity of the cylindrical body at the first end.

* * * * *